United States Patent [19]

Moreno

[11] Patent Number: 4,836,537

[45] Date of Patent: Jun. 6, 1989

[54] HANDLE FOR AN EXERCISER DEVICE

[76] Inventor: Gilbert Moreno, 50 Avenue Louis Blanc, 94210 La Varenne Saint Hilaire, France

[21] Appl. No.: 107,587

[22] Filed: Oct. 13, 1987

[30] Foreign Application Priority Data

Oct. 17, 1986 [FR] France ..... 86 14444

[51] Int. Cl.[4] ..... A63B 21/30

[52] U.S. Cl. ..... 272/143; 272/137

[58] Field of Search ..... 272/134–143, 272/121, 125, 126

[56] References Cited

U.S. PATENT DOCUMENTS

| | | | |
|---|---|---|---|
| 2,356,260 | 8/1944 | Maxwell | 272/143 |
| 3,117,782 | 1/1964 | Johnston | 272/121 |
| 4,685,671 | 8/1987 | Hagerman et al. | 272/136 |

FOREIGN PATENT DOCUMENTS

| | | |
|---|---|---|
| 0020903 | 1/1981 | European Pat. Off. . |
| 130173 | 4/1902 | Fed. Rep. of Germany . |
| 698210 | 11/1940 | Fed. Rep. of Germany . |
| 2042874 | 3/1972 | Fed. Rep. of Germany . |
| 2100873 | 7/1972 | Fed. Rep. of Germany . |
| 3309620 | 9/1984 | Fed. Rep. of Germany . |

*Primary Examiner*—Richard J. Apley
*Assistant Examiner*—J. Welsh
*Attorney, Agent, or Firm*—Young & Thompson

[57] ABSTRACT

The present invention relates to the handle for an exercise device, in the general shape of an open C including a rigid half hoop with a fixation member at one end for the ends of one or more resilient resistant members or straps and, at the other end, a short bar the central portion of which extends substantially through the fixation member. This handle for an exercise device allows connection of two handles by an intermediate bar in back to back relation and use of the handle as a hooking device about the lower limbs of the user.

4 Claims, 2 Drawing Sheets

HANDLE FOR AN EXERCISER DEVICE

FIELD AND BACKGROUND OF THE INVENTION

The present invention relates to handles for exercise devices and similar gymnastic or body building apparatus. The known handles are in the shape of a stirrup, with members exerting a similar elastic resistance fixed at the top of the stirrup hoop through the engagement of hooks provided at the end of the resistance member in a buckle rigidly connected to the hoop. The gripping portion or handle is generally formed of a bar subtending the stirrup hoop, whereby a sleeve with an outer diameter adapted to be gripped by the hand is generally rotatably mounted on said bar.

The handles are exclusively designed for exercise devices of the upper limbs.

OBJECTS AND SUMMARY OF THE INVENTION

The object of the present invention is to provide a handle for an exercise device allowing its use for training the upper as well as the lower limbs, whereby two handles can be transformed into a resilient trapeze bar.

The exercise handle according to the invention is characterized in that it has the general shape of an open C and includes a rigid half hoop with, at one end, a fixation member for the resilient resistant members or straps and, at the other end, a short bar have a longitudinal axis, the perpendicular of which at the center of the bar extends substantially through the hereabove fixation member.

According to preferred embodiment, the fixation member is made of a rectangular housing lying substantially in the plane of the hoop, and in which is engaged a flat buckle fixed to the end of an elastic band or a strap with releasable keying means securing the buckle against motion within its housing. According to another embodiment, the female element of the fixation member is rigidly connected to the sandow or strap end and is formed with a slot inside which fits a flat adapter integral with the handle, with releasable keying means securing the flat adapter against motion inside the female element housing. According to another feature, there is provided a peripheral clearance between the nesting portion of the female element and the nested portion of the male element in order to permit rotation of the handle around the support generating line of the keying means.

According to another feature, the fixation member is made of a threaded adapter or of a tapped housing cooperating with a threaded ring or a threaded adapter attached to the end of the sandow made from a resilient cable.

According to another characteristic, the short bar is tubular in order to receive the end of a bar ensuring the junction between two of the handles, with an interlocking means between each handle and the bar. The interlocking means can be of the bayonet type or a ball keying device, the advantage of the latter being that the bar remains free to rotate with respect to the hoop forming the handle.

According to another characteristic, a cylindrical element is telescopically mounted in the axis of each handle such as to protrude over a limited extent at the end of the handle sleeve away from the half hoop, and the telescopic cylindrical elements of two handles include at their protruding end complementary interlocking means.

According to another characteristic, the half loops or the handle axes include, at their end which is opposite the sleeve, complementary interlocking means for rigidly fixing two handles back to back.

According to another feature, a sleeve is mounted in a known manner on the short bar, the sleeve including along various generating lines gripping and/or support surfaces of different natures, with the sleeve being lockable in a rotary position in order to orient a definite gripping and/or support surface toward the inside of the handle. The gripping and/or support surfaces can be a gripping surface with a shape conforming to that of the fingers, a gripping slot for the engagement of the ends of the fingers, a cushion or a small board shaped for supporting the Achilles tendon or ankle, etc. The sleeve can also be removable and fixed to the short bar by the same interlocking means as the connecting bar, preferably through an interlocking means of the bayonet type which does not allow a relative rotation, or a key locking in position the ball keying. In such a case, each sleeve preferably includes a single gripping surface of its own.

BRIEF DESCRIPTION OF DRAWINGS

The invention will now be described in more detail with reference to the accompanying drawings wherein.

DETAILED DESCRIPTION OF THE INVENTION

Figure 1:
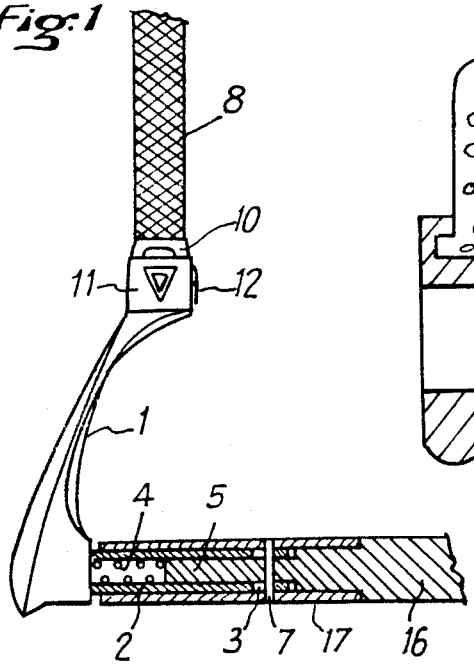
FIG. 1 is an elevation view, partly in section, of the handle according to the invention fixed to the end of a or resilient resistance member formed of a strap and coupled to a connecting bar.

In the drawings, reference numeral 1 designates the rigid half hoop, made of metal or molded plastic material, and reference numeral 2 the short bar forming the axis of the handle. In the embodiment shown in FIGS. 1 and 2, the short bar 2 is tubular and is formed at its end with two bayonet-shaped notches 3, symmetric to one another with respect to the axis and, in the bottom of the tube is housed a resilient element such as a spring 4 biasing an axial core 5 carrying the axis of the bayonet interlocking device 7 of the element mounted on the short bar 2 in order to maintain the interlocking engagement by pushing device 7 back inside the side housing of notches 3. This embodiment can be modified and the handle can be rotatably mounted in a known manner about the short bar 2 which can be solid and having an internal thread at the end, into which is screwed a screw maintaining the handle on the bar but authorizing it to rotate freely.

Figure 3:
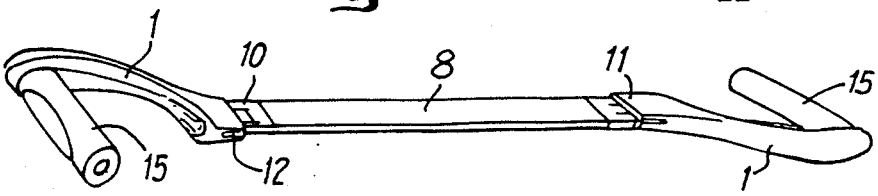
FIG. 3 is a perspective view of two handles fixed to both ends of a sandow.

At the other end of the half hoop 1 is mounted a fixing member for the resilient traction element which, in general, is a sandow formed as an elastic band 8 or an elastic cable 9, or possibly a non-elastic strap. The interlocking device between the end of the sandow and the hoop can be any one of the known devices. In FIGS. 1 and 3 is shown a flat buckle 10 fixed at the end of band 8 and the buckle is driven inside a housing of mating shape 11 at the end of the half hoop 1 and is locked inside the housing by a catch 12.

Figure 2:
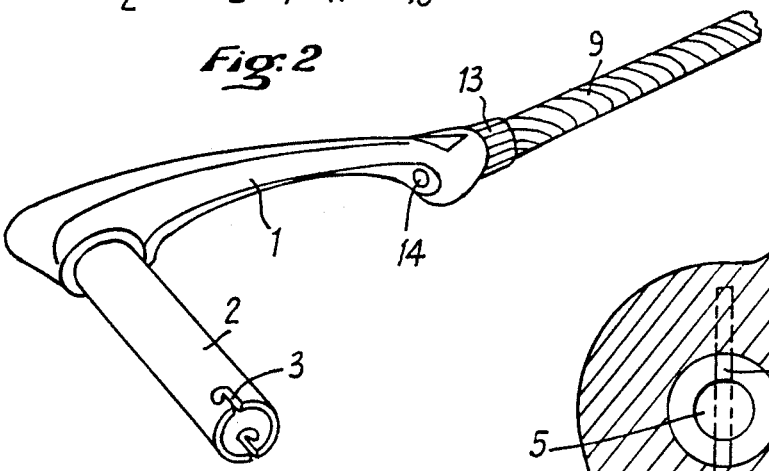
FIG. 2 is a perspective view of a handle fixed to the end of a sandow formed of a cable.

In the embodiment of FIG. 2, a threaded ring 13 is fixed at the end of the sandow 9 and a threaded rod 14, of which only the end portion is shown, is imbedded in the half hoop 1 head, with the threaded ring being screwed onto the end of said threaded rod.

In the embodiment of FIG. 3 are shown two handles, each made of a half hoop 1 and a sleeve 15, which are mounted at both the ends of a sandow 8, but it is obvious that the sandow could have only a single handle, its other end being anchored in a known manner.

In the embodiment of FIG. 1, two half hoops 1 which are each rigidly connected to a sandow 8 (only one of the half hoops being shown) are joined by a bar 16 which can be a bar of the type disclosed in FR-A-No. 2 544 617 or FR-A-No. 2 548 912. The bar 16 is rigidly connected to each half hoop 1 by a bayonet type connection such as described above, with a sleeve 17 covering the short bar 2.

The handle fixed onto the bar 2 can be a simple sleeve, but due to the fact that it can be secured against a rotary motion, it is possible to adapt it to specific uses.

Figure 4:
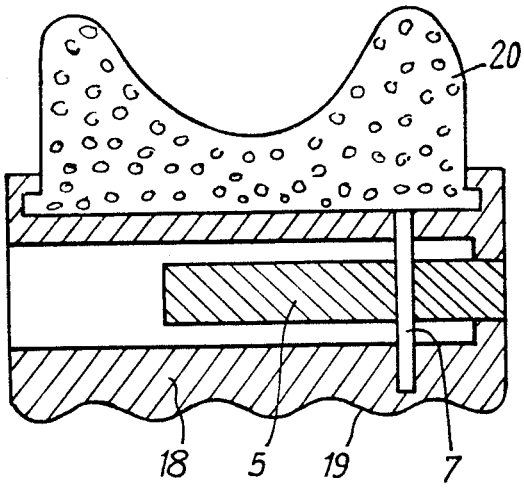
FIG. 4 is a sectional view at a larger scale of a removable gripping sleeve.

As shown in FIG. 4, the handle formed of a sleeve 18 can have, on half its periphery, a profile 19 improving the grip by the fingers and, on the opposite periphery, a foam cushioning 20 allowing engagement of the user's ankle through the half hoop 1 in order to exercise the thigh and lower limb muscles.

Figure 5:
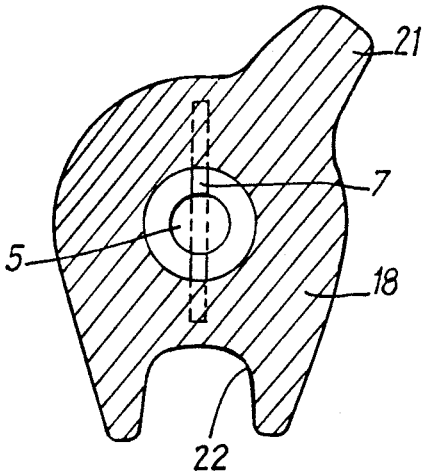
FIG. 5 is a transverse sectional view at a larger scale of a gripping sleeve specialized for the training of mountaineers.

In the embodiment of FIG. 5, sleeve 18 is formed at its periphery with a ridge 21 and a groove 22 allowing the user to simulate the grips of a mountaineer.

Figure 6:
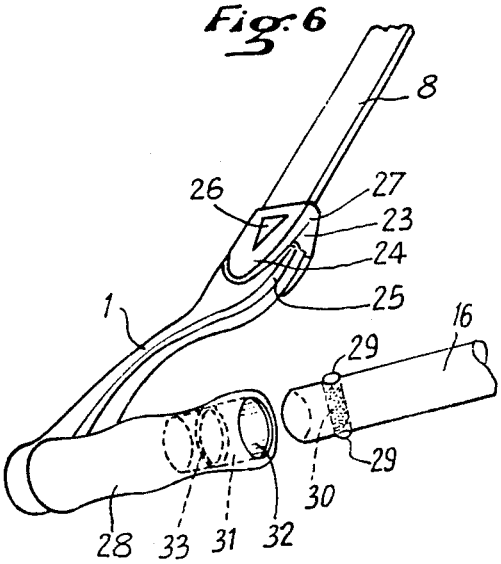
FIG. 6 is a perspective view of another embodiment of the handle according to the invention.

In FIG. 6, the same elements or equivalent elements are designated by the same references. At the end of the sandow or strap 8 is fixed the female element 23 forming a fork with two parallel plate-shaped arms 24 between which is engaged the end 25 forming a flat of the half hoop 1. A releasable keying system 26 of the known type ensures the connection between the two elements. A clearance provided in the interlocking position at 27 permits a limited rotation between the buckle 23 and the half hoop 1, and therefore between the axis of strap 8 and the handle 28 rotatably mounted on the half hoop 1.

The interlocking of bar 16 with handle 28 is obtained by a ball keying. Two balls 29 are housed in a diametrical bore at each end of bar 16 with, interposed therebetween, a spring 30. They are held in the bore by crimping, but protrude with respect to the peripheral surface of bar 16.

In the end of handle 28 is formed an inner recess 31 which can receive the end of the bar, the recess being closed by a removable cap 32 while a groove 33 is formed in the wall of the cylindrical recess. When one drives in the end of bar 16 inside recess 31, the balls 29 are resiliently retracted until they fall back inside groove 33 for providing, in the known manner, the resilient locking against a relative longitudinal displacement between bar 16 and handle 28, respectively, of the half hoop 1. Bar 16 can rotate relative to handle 28, with the balls 29 rolling inside groove 31.

Figure 7:
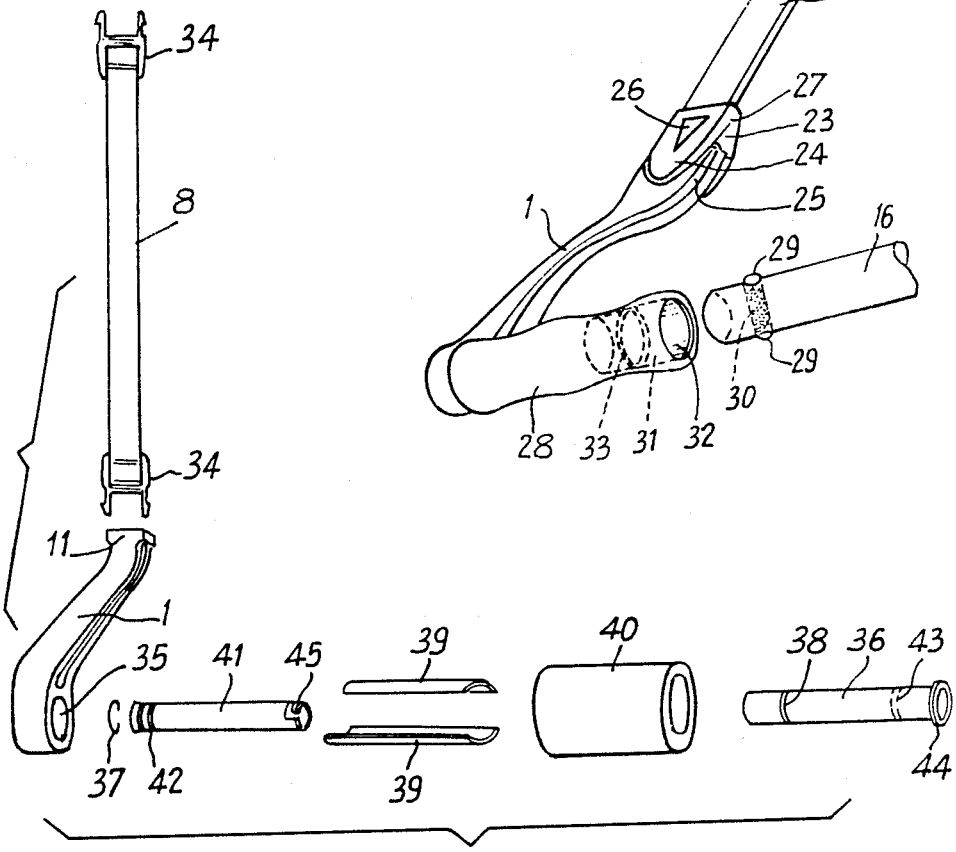
FIG. 7 is an exploded view of a handle according to still another embodiment.
Figure 8:
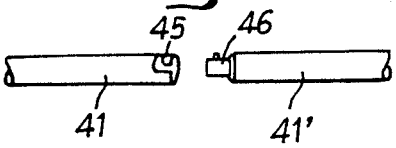
FIG. 8 is a detailed view of FIG. 7.

The object of the embodiment of FIGS. 7 and 8 is to avoid the necessity of having a special bar such as 16 for providing the junction between two handles. In the embodiment shown, there is the sandow 8 with a buckle 34 at both ends thereof formed of two resilient hooks turned in opposite directions, which engage in housings 11 at the end of half hoop 1. The handle as such is made of a tubular element 36 forming an axis which fits in the cylindrical bore 35 of half hoop 1. The tubular element 36 is held in position inside bore 35 for example by a slit resilient snap ring 37 engaged in the peripheral groove 38 of tubular element 36 and in a groove, non-visible, formed in the surface of bore 35. This assembly could also be obtained with an abutment element rigidly connected by screwing to the end of the tube, the head of the element abutting against the outer face (non-visible) of the half hoop 1. The handle as such is made of two channel-shaped bearing surfaces 39 mounted in sleeve 40 and held in position by bearing on the inner face of half hoop 1 and abutting against the end flange 44 of tubular element 36.

Inside element 36 is slidably mounted a half bar, respectively 41–41'. The protrusion of the bar beyond flange 44 is for example limited by a snap ring similar to 37 mounted in a groove 42 of the half bar and abutting against a protruding inner flange 43 of tubular element 36, or any similar device.

One of the half bars 41 carries at its end the female element 45 of a bayonet type connection, and the other 41' carries the corresponding male element 46. Once they are out, the two half bars are rigidly interconnected by the bayonet type connection and one obtains the same resilient trapeze as in FIG. 1.

Figure 9:
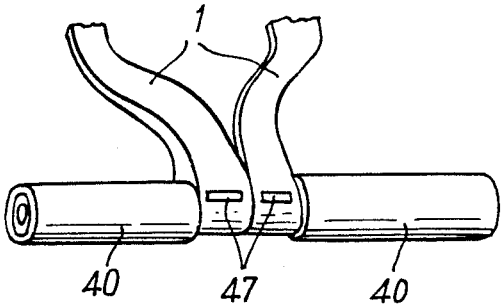
FIG. 9 is a view illustrating another assembly position of the two handles according to the invention.

In FIG. 9 is shown another mode of assembly of the two half hoops 1 which are back to back, thereby providing two sandows acting in parallel, with the handles 40 outside. The interlocking of the two handles can be realized in any manner, for example by a clamp, not shown, engaging inside the two notches 47 and inside two other notches diametrically opposite while surrounding the base of the half hoops between the handles 40, or by a connecting part with a double bore used instead of the two abutment elements hereabove described with reference to FIG. 7.

The handles can also be used advantageously in exercise devices other than those of the suspension and traction types and, for example, in exercise devices made of an element having a flexing strength when subjected to the action of torques applied at its two ends. In such a case, the handles are rigidly fixed to the two ends of the flexible bar which includes in its center a bearing surface for the nape of the neck, the exercise device being used by bringing both handles toward each other from the positions in alignment with the shoulders in order to juxtapose them in front of the chest.

What is claimed is:

1. A handle having a generally C-shaped configuration for use with an exercise device, comprising (a) a rigid half hoop member;

(b) a fixing device arranged at one end of said half hoop member for connection with at least one flexible resilient resistance device;

(c) a relatively short bar arranged at the other end of said half hoop member, said bar having a longitudinal axis, the perpendicular of which at the center of said bar passes through said fixing device;

(d) a sleeve mounted on said bar; and (e) a cylindrical member telescopically connected with and coaxially arranged relative to said bar, said cylindrical member protruding beyond said sleeve and including interlocking means at the remote end thereof for connection with the cylindrical member of a second handle to connect the handles together.

2. A handle having a generally C-shaped configuration for use with an exercise device, comprising (a) a rigid half hoop member;

(b) a fixing device arranged at one end of said half hoop member for connection with at least one flexible resilient resistance device;

(c) a relatively short bar arranged at the other end of said half hoop member, said bar having a longitudinal axis, the perpendicular of which at the center of said bar passes through said fixing device; and (d) a sleeve mounted on said bar; said hoop member including interlocking means on the surface thereof opposite said sleeve for connecting adjacent handle together in back to back relation.

3. A handle having a generally C-shaped configuration for use with an exercise device, comprising (a) a rigid half hoop member;

(b) fixing means arranged at one end of said half hoop member for connection with at least one flexible resilient resistance device; and (c) a relatively short bar arranged at the other end of said half hoop member, said bar having a longitudinal axis, the perpendicular of which at the center of said bar passes through said fixing means;

(d) said fixing device comprising a housing including a female housing member connected with said resistance device, a flat male adapter member integrally formed with said hoop member, and releasable keying means connected with said female housing member for securing the flat male adapter member against motion within said female housing member, said female housing member containing a peripheral opening permitting rotation of the handle about said keying means.

4. A handle having a generally C-shaped configuration for use with an exercise device, comprising (a) a rigid half hoop member;

(b) a fixing device arranged at one end of said half hoop member for connection with at least one flexible resilient resistance device;

(c) a relatively short bar arranged at the other end of said half hoop member, said bar having a longitudinal axis, the perpendicular of which at the center of said bar passes through said fixing device; and (d) a sleeve having a contoured gripping surface mounted on said bar, said sleeve including means for locking said sleeve in a given rotary position relative to said bar to orient said gripping surface toward the inside portion of the handle.

* * * * *